US005302207A

United States Patent [19]

Jurcisin

[11] Patent Number: 5,302,207

[45] Date of Patent: Apr. 12, 1994

[54] LINE STRIPER APPARATUS WITH OPTICAL SIGHTING MEANS

[76] Inventor: Gregory D. Jurcisin, 114 Cleveland Ave., Milford, Ohio 45150

[21] Appl. No.: 869,751

[22] Filed: Apr. 16, 1992

[51] Int. Cl.[5] ..... B05C 11/00; B05B 15/04

[52] U.S. Cl. ..... 118/713; 33/286; 118/207; 118/305; 239/150; 401/48; 404/94

[58] Field of Search ..... 118/305, 713, 207; 239/150, 151; 404/93, 94; 427/137; 359/402; 401/48; 33/286, 288

[56] References Cited

U.S. PATENT DOCUMENTS

| | | | |
|---|---|---|---|
| 1,610,773 | 12/1926 | Hansen | 118/305 |
| 1,763,432 | 6/1930 | Kirkman | 118/305 |
| 1,928,551 | 9/1933 | Ball | 401/48 |
| 2,130,356 | 9/1938 | Marshall | 118/207 |
| 2,221,908 | 11/1940 | Bossi | 118/305 |
| 2,278,948 | 4/1942 | Rodli et al. | 118/305 |
| 2,317,288 | 4/1943 | McCubbin | 239/150 |
| 2,518,952 | 8/1950 | Sohmer | 239/165 |
| 2,633,382 | 3/1953 | Dudley et al. | 118/305 |
| 2,788,240 | 4/1957 | Wilson et al. | 239/303 |
| 2,974,875 | 3/1961 | Brown | 239/150 |
| 3,007,645 | 11/1961 | Little | 239/150 |
| 3,266,392 | 8/1966 | Angelini | 401/48 |
| 3,298,352 | 1/1967 | Vrablik | 118/305 |
| 3,540,632 | 11/1970 | Clingan | 239/150 |
| 4,167,592 | 9/1979 | Gabel et al. | 427/137 |
| 4,267,973 | 5/1981 | Stewart | 118/305 |
| 4,545,531 | 10/1985 | Williams | 118/305 |
| 4,861,190 | 8/1989 | Glassel | 118/305 |
| 4,893,751 | 1/1990 | Armstrong | 118/305 |

FOREIGN PATENT DOCUMENTS

| | | | |
|---|---|---|---|
| 3017235 | 11/1981 | Fed. Rep. of Germany | 404/95 |
| 1329940 | 12/1963 | France | 404/94 |
| 2609068 | 7/1988 | France | 404/94 |
| 1022496 | 3/1966 | United Kingdom | 404/94 |

OTHER PUBLICATIONS

Publication by Hines, "Truck Outfit for Painting Pavement Center Lines", Engineering News-Record, No. 807, published Nov. 9, 1922.

*Primary Examiner*—Joseph W. Drodge
*Attorney, Agent, or Firm*—Wood, Herron & Evans

[57] ABSTRACT

A line striper with optical sighting means, and guide line marking devices adapted to be used simultaneously with the application of a paint stripe. The line striper has a forward extending guide bar for direct sighting on the surface to be marked, as well as an optical sighting means for aligning the line striper on a distant fixed point for application of a guide line. Adjustable length booms mounted transverse to the line striper allow application of guide lines a distance removed from the paint spray nozzle. The line striper has multiple paint reservoir paint storage capability to facilitate application of different color paints.

24 Claims, 6 Drawing Sheets

LINE STRIPER APPARATUS WITH OPTICAL SIGHTING MEANS

FIELD OF THE INVENTION

The invention relates to a line striping apparatus having improved sighting and guide line marking features, and particularly to a hand-propelled line striper apparatus operated by a single person which is capable of simultaneously applying both a paint stripe to a surface and marking a guide line for later paint striping.

BACKGROUND OF THE INVENTION

Line stripers have been employed for a number of years to apply permanent lines to surfaces such as roadways, parking lots, and the like. Particularly in the instance of striping areas for parking, the line striping procedure is typically at least a two-man operation. These areas usually require a line striper which is highly maneuverable. Thus, a walk-behind unit is preferred, though small self-propelled units are useful also.

In preparation for striping a surface, such as a parking lot, first the surface to be marked must be measured, followed by performing the calculations necessary to optimize the use of the available space, such as by providing the maximum number of equally sized stalls for automobiles. Then, to ensure that the paint stripes applied to the parking surface are straight and of the correct length, the parking surface is typically premarked using stretched chalk lines and hand-drawn lines over which the paint stripe is applied. For applying guide lines, two workers are needed to stretch a chalk line the necessary distance and snap a mark onto the surface. Over longer distances, the string or cable tends to develop a curve in the presence of any breeze, which has substantially more effect on the line even at low wind speeds in an exposed open area such as a parking lot. Individual lines defining the sides of the parking stalls are laid out referencing the chalk line and are marked on the surface by stretching shorter lengths of chalked lines between two points. Those lines perpendicular to the base line are laid out by the use of a T-square or other measuring tool or method.

Where permanent paint lines are used to mark or outline driving lanes, walkways, dividers and the like, curved lines may need to be applied. Where, for example, a curved driving lane or bicycle path must be striped, it is often necessary to mark one side of the lane by free hand, and then trace a second line equidistant from the first to create the lane. However, it is difficult to use this method to accurately mark the curved line.

These marking operations are time-consuming and will typically require at least two persons to accurately chalk the parking area prior to striping. Because the chalking operation involves the use of powdered chalk on a line or cable, it is typically not possible to mark the guide line when it is raining, or even when the parking surface is wet from a previous application of water. Also, the powdered chalk is easily lifted from the surface by rain or other application of water.

Once the parking area or other surface to be marked has received the guide lines, the line striper apparatus is then used to apply the paint stripe, with or without added glass beads for reflectivity, and thereby provide the permanent lines for the surface to be marked. Typically, the line striper apparatus has a single paint gun offset from the wheel which is directed downwardly and located on the forward portion of the line striper.

Forward placement allows the operator to more easily see the stripe being applied. The offset is required to insure that the wheels of the line striper do not roll though the drying paint.

This type line striper performs adequately in large open areas. However, where the line stripe must be applied near to a curb or island, the paint gun is often improperly positioned to complete the striping of the line. Where the clearance is insufficient to use the mounted paint gun, hand spraying is often required, which is less precise and provides more irregular results.

SUMMARY OF THE INVENTION

It has been an object of the invention to provide a line striper wherein the steps of marking the guide line and applying the paint stripe can be accomplished by a single operator.

It has been a further object of the invention to provide a line striper which can apply a paint stripe from a mounted paint gun in constricted areas.

It has been a further object of the invention to provide a line striper which can mark a guide line at the same time it is applying a paint stripe.

It has been yet a further object of the invention to provide a line striper which can mark a guide line onto a surface over a long distance without the use of a separate chalk line or cable.

It has been yet a further object of the invention to provide a manual line striper having multiple paint reservoirs mounted thereon for application of different color paints to a surface.

It has been yet a further object of the invention to provide a method of striping a surface with a single operator without a chalked line or cable.

These and other objects and advantages of the invention are obtained by a line striper fitted with at least one downwardly directed paint gun, a guide line marking device, and various attachment sites for receiving one or a number of accessories which facilitate guide line marking and permanent line striping using a single or multiple paint colors.

The line striper of the invention must be sufficiently maneuverable to apply guide lines and paint stripes along corners and edges, and in other restricted spaces encountered on surfaces used for parking cars. Thus, the invention is directed primarily to walk-behind line stripers and optionally smaller propelled riding units with sufficient maneuverability. However, certain of the aspects of the invention are applicable to larger propelled striping machines.

The line striper of this invention is comprised of a mobile platform, preferably on fixed plane wheels to facilitate the striping of a straight line, upon which is mounted a paint dispensing apparatus, a guide line marking device, and at least one sighting device which permits the operator to apply either a paint stripe or a guide line, or both, while guiding the apparatus using the sighting device.

An optical sighting means is used to apply a guide line over a longer distance without the need for a second person to assist in snapping a chalk string or cable. The optical sighting means is comprised of a periscope device fitted to the platform, which is sighted onto a fixed point forward of the line striper to allow viewing of the fixed point from an apparent position adjacent the surface. Forward of the viewing port of the periscope and on the same line with the fixed point, is the guide line marking device. After the operator sets the line striper at the start point for the longer distance line and aligns the striper with the fixed point by centering the periscope sight hair on the fixed point, the operator walks toward the fixed point and engages the guide line marking device. By maintaining the periscope sight hair, marking device, and fixed point on the same line, the resultant guide line is essentially straight and can then be covered by a subsequent application of a permanent paint stripe. It is believed that viewing the fixed point from the apparent vantage point adjacent the surface results in a guide line which is not substantially affected by fluctuations in the surface to be marked. Where the surface is more uniformly flat, an optical sighting device viewing the fixed point directly from the operator's eye level can provide satisfactory results. However, this type of sighting device would not directly view the guide line marking device.

To apply a paint stripe and simultaneously mark a discrete guide line, the guide line marking device is typically positioned on a boom which mounts to the line striper platform, and which terminates at a wheel to maintain a fixed distance between the marking device and the surface to be marked. The line striper has two mounting sites on the platform for accepting booms, and two positions on each site for securing the marking device. The booms can be adjusted to desired lengths to apply a guide line a fixed distance from the paint stripe or from the spray nozzle location if no stripe is being applied. Thus, if the operator desires to form parking stalls having nine-foot horizontal widths, the boom is adjusted to provide a nine-foot spacing from the spray nozzle to the point of contact of the marking device. Booms can be positioned onto the platform on one or both sides of the platform, so long as the distance of the guide line from the paint stripe in this instance is nine feet. A the stripe is applied, the operator engages one or both of the levers actuating the respective marking devices to apply a guide line on one or both sides of the paint stripe. After the first paint stripe is applied, the operator then repositions the line striper so that the nozzle is over one guide line, and applies the second paint stripe, taking care to prevent any of the line striper or boom wheels from rolling through the wet paint during repositioning. If the booms are maintained in position, one boom will be again nine feet from the line being striped, and the marking device lever can be actuated to simultaneously mark another guide line as the second paint stripe is applied. The booms are constructed to be hingeable at a point near the mounting site on the line striper platform. When the line striper reaches a constricted area, such as the edge of a parking lot near a wall, the boom can be tilted upward and out of the way while the striper is used at the edge.

To facilitate the application of the paint stripe over a guide line, a separate guide bar is provided which is positioned forward of the line striper and when fully extended, lies essentially parallel to the surface being marked. This guide bar preferably has one or more prongs which the operator uses to assist him in applying the paint stripe while moving the line striper forward, and is adjustable to suit the specific operator. The guide line on the surface is maintained at a fixed point relative to the center prong on the guide bar as the operator walks forward during the paint stripe application.

The operation of the line striper, as well as the guide line marking and optical sighting features, and method of applying, are described in the detailed description to follow, and in the drawings, in which:

DETAILED DESCRIPTION OF THE INVENTION

In its broader aspects, the invention relates to a striping apparatus for applying a paint line to a surface, comprised of a mobile platform, paint dispensing apparatus mounted on the mobile platform for applying a paint line to a surface, and an optical sighting means mounted on the platform and adapted to be viewed by an operator and sighted onto a fixed point. The striping apparatus further includes a guide line marking device for applying a chalk line to the surface, which precedes and facilitates the application of a paint stripe. To further facilitate the application of a paint stripe over a guide line, the striping apparatus is also equipped with a guide bar which is extendable forward of the mobile platform and is used by the operator to guide the mobile platform while applying a paint stripe.

Regarding the optical sighting means, it has been found that good results are obtained with a periscope unit attached to the mobile platform which is used to view a fixed point toward which the mobile platform is guided from an apparent vantage point directly above the surface to be marked. Typically, the periscope unit is used by the operator to apply a soapstone or chalk line over a longer distance prior to the application of a paint stripe. The operator lines up the fixed point with a sight hair inside the periscope. When applying the guide line, the marking device is positioned directly forward of the periscope viewing port and on line with the sight hair. To apply the line, the operator directs the mobile platform toward the fixed point, maintaining the fixed point, marking device and sight hair in the same line, and actuates the marking device.

The periscope is optionally fitted with a secondary guide bar which is essentially parallel to both the surface to be marked and the axis of rotation of the fixed plane wheels on the mobile platform. Thus, relative to a guide line or a paint stripe being applied by the line striper, this bar will be perpendicular to either of these lines. Where a second paint stripe or guide line is to be applied at right angles to a first stripe or guide line, the striping apparatus is positioned so that the secondary guide bar overlies the first stripe. As the striping apparatus is moved forward, either with application of a paint stripe or a guide line, these lines will be perpendicular to the first paint stripe.

The various sighting and guide line marking features of this invention allow a single operator to apply guide lines and paint stripes to a surface, where previously two or more persons were required. As a result, the method of striping a surface is simplified, is more accurate, and can be completed in less time.

Figure 1:
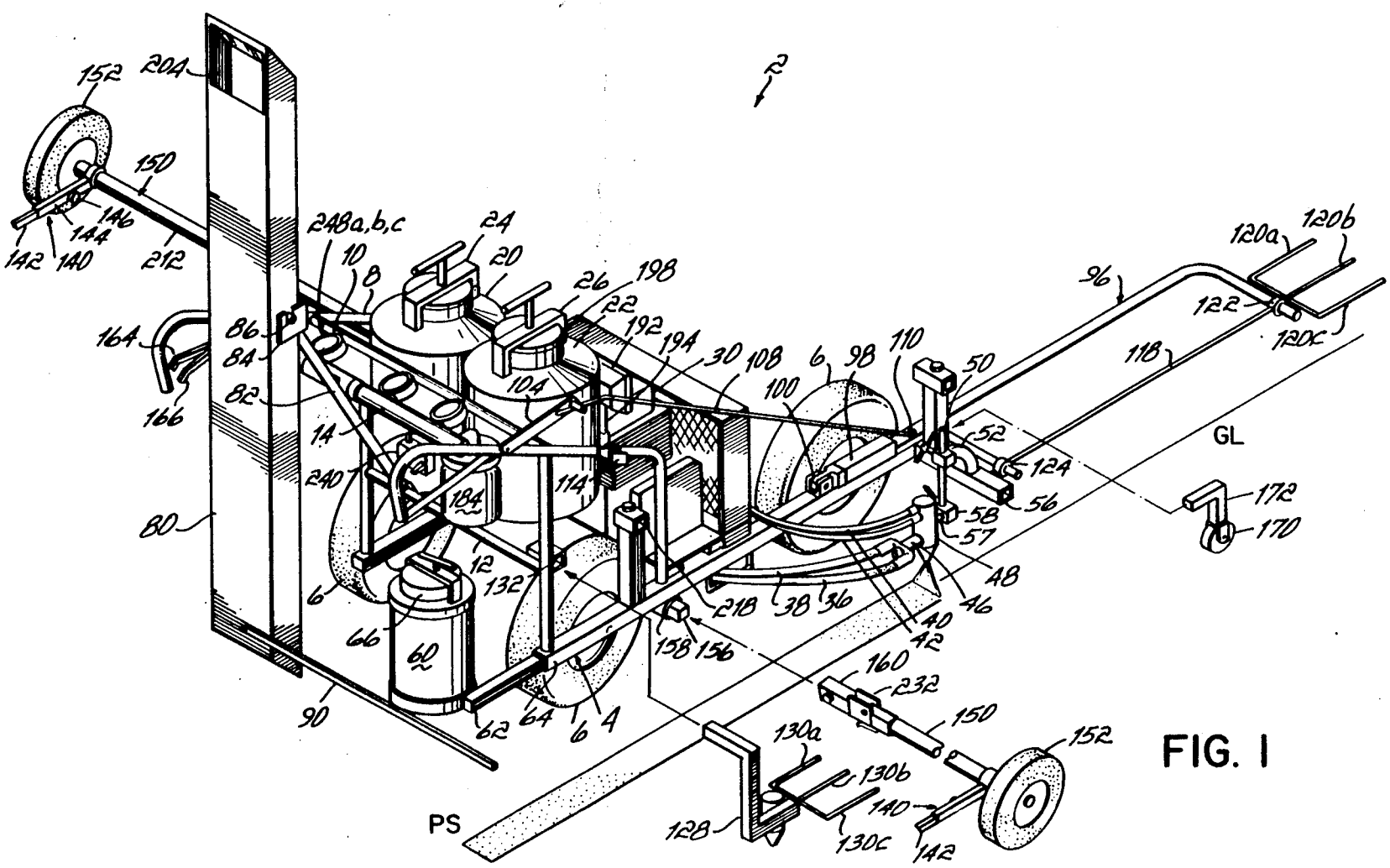
FIG. 1 is a perspective view of the line striper depicting various optical sighting means and the guide line marking device booms.

Referring to the drawings, FIG. 1 depicts the line striper 2 showing the various attachments either in place or positionable on the device. A tubular frame 4 is mounted to fixed plane wheels 6 which cause the line striper 2 to move forward or backward along a straight line. To the tubular frame 4 is mounted the handle assembly 8. The handle assembly 8 is stiffened by upper cross bar 10, lower cross bar 12, forward cross bar 16 and further by the air manifold 14, which also provides support. The tubular frame 4, handle assembly 8, cross bars 10, 12 and 16, and air manifold 14 are typically constructed from welded tubes of chrome-moly steel, to provide rigidity and strength at minimal weight. Good results have been obtained by fabricating the tubular frame 4 from 1.5 inch square chrome-moly steel with 0.065 inch wall thickness. The handle assembly 8 and cross bars 10, 12, and 16 have been satisfactorily fabricated from 1.0 inch chrome-moly steel with a 0.065 inch wall thickness. Air manifold 14 was fabricated from 1.5 inch hydraulic tubing with a 0.125 inch wall thickness.

The paint is stored in one or both of paint reservoirs 20 and 22 bolted onto the tubular frame 4. These reservoirs are constructed of 14 gauge steel and are pressurizable, and paint is added via hatches 24 and 26, which can be secured to withstand the pressures needed to apply the paint. Paint is drawn from the reservoir, and in like manner for reservoir 20, through a bottom take off 28, shown in FIG. 2.

Figures 6, 9:
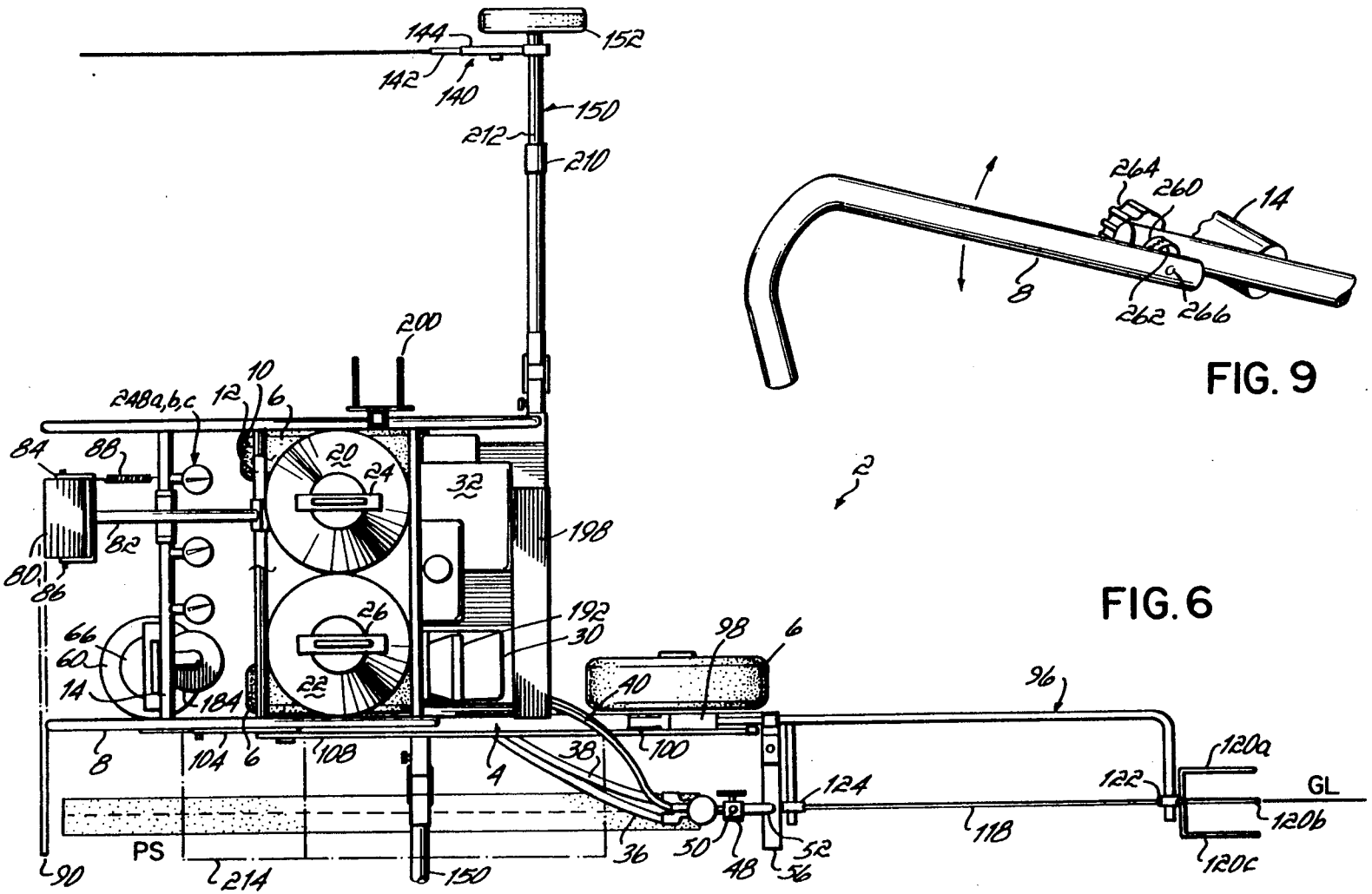
FIG. 6 is a top elevational view of the line striper.
FIG. 9 is an enlarged perspective view of an alternative embodiment of the handle assembly.

The paint reservoirs 20 and 22 are pressurized using compressor 30, which is powered by gasoline engine 32 (FIG. 6). Paint is supplied from the reservoirs 20 and 22 via transfer lines 36 and 38 to the paint gun 48. The valves inside paint gun 48 which open to permit paint flow from reservoirs 20 and 22 are actuated by operating air line 40. Operating air line 40 also activates line 42, which supplies atomizing air to paint gun 48. The paint gun 48 is connected to a rod member 50. The paint gun 48 can be adjusted in height by vertically moving rod member 50 within gun bracket 52, which in turn is mounted to receiver tube 56 mounted to the tubular frame 4. The paint gun 48 also rotates through rotation of rod 57 which is securable to block 58, to permit the spraying of surfaces such as vertical curbs, and the like.

In striping parking lots and other similar surfaces, the most common paint colors are yellow and white. Thus, the paint reservoirs 20 and 22 would typically store white and yellow paint or alternatively, white or yellow paint in both reservoirs, where larger quantities of a single color are needed. In certain situations it is desired to use yet another color of paint, such as blue for painting handicapped parking stalls. In the event that a smaller amount of a different color paint is required for surface spraying, a secondary paint reservoir 60 can be mounted onto tubular frame 4 by inserting the reservoir support bar 62 into the reservoir receiver tube 64 at the end of tubular frame 4. The paint is loaded into the secondary paint reservoir 60 via hatch 66. Pressure is supplied to the secondary paint reservoir 60, and paint is carried to paint gun 48, in the same manner as from reservoirs 20 and 22 by paint transfer lines (not shown).

Guiding of the line striper 2 is facilitated by both optical sighting mean and separate guide bars. One optical sighting means which has proven effective in use is a periscope 80 which is mounted to the tubular frame 4 by periscope support member 82. The periscope support member 82 has a notched bracket 84 which receives the mounting pin 86 mounted on periscope 80 at both sides. Periscope 80 is constructed from aluminum in the form of a tube, selected for its durability and stiffness properties. The inside surfaces of the periscope 80 are blackened to decrease glare. The periscope 80 is better maintained in a vertical position relative to the surface by positioning the mounting pins 86 so that most of the weight of the periscope 80 is below the mounting pins 86. To minimize free rotation of periscope 80 about mounting pins 86, a spring 88 is positioned between and connected to periscope 80 and support member 82 by securing the ends of the spring 88 into holes in the periscope 80 and support member 82. As the line striper 2 moves over irregular surfaces, the periscope 80 tends to rotate about the mounting pins 86. To maintain the periscope in the proper viewing position, the operator manually restricts movement of the periscope 80 as necessary. A thumb loop (not shown) or other protruding member on the periscope 80 is useful for restricting movement.

At the bottom of periscope 80 is a secondary guide bar 90 which is essentially parallel to the surface and the axis of rotation of the fixed plane wheels 6. This secondary guide bar 90 is thus positioned essentially perpendicular to the line of direction of the line striper 2. Where a first paint stripe is already on the surface, and a second stripe at right angles must still be applied, the secondary guide bar 90 is positioned so that it overlies the first paint stripe before applying the second stripe.

Figure 2:
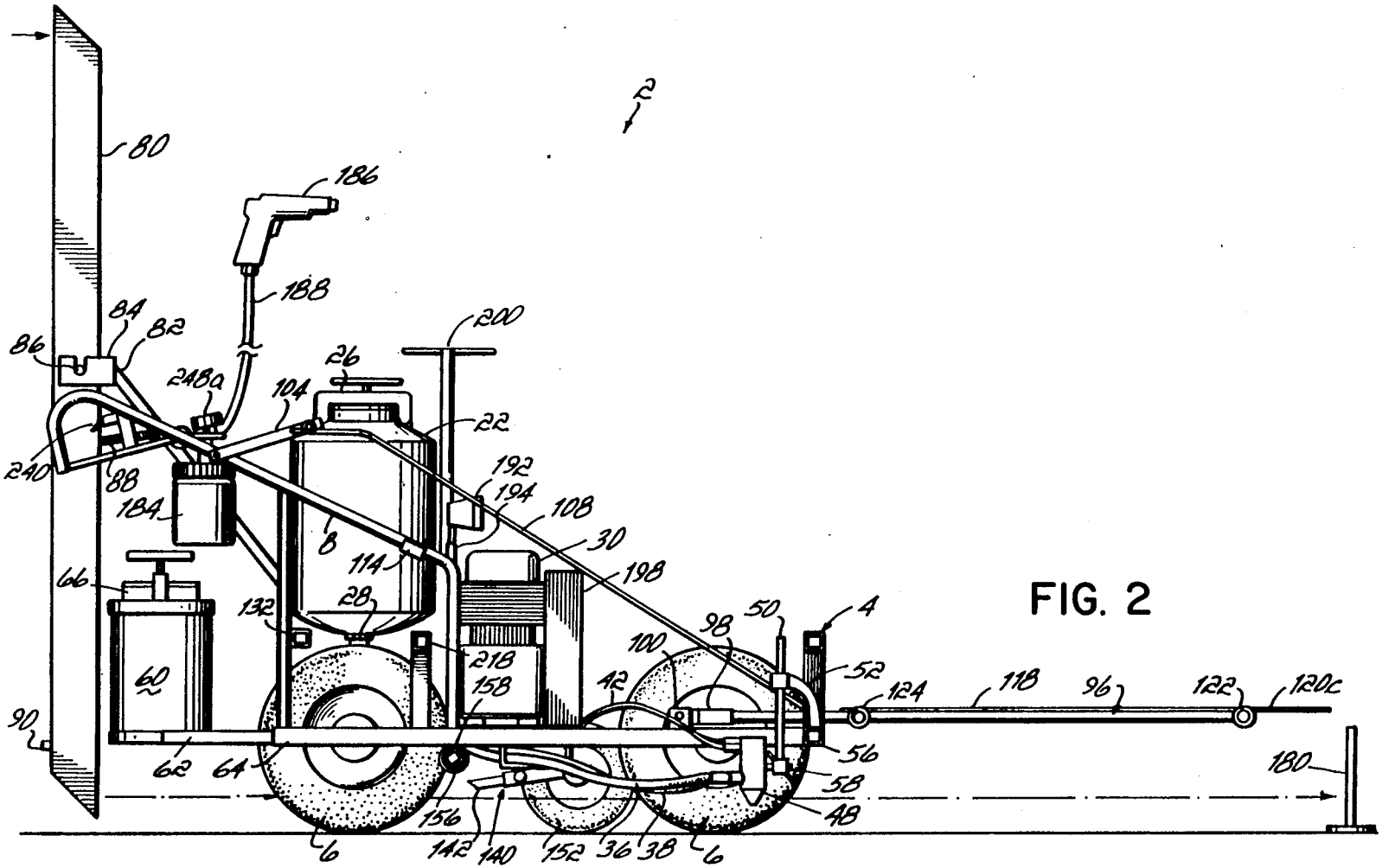
FIG. 2 is a side elevational view of the line striper device.
Figure 3:
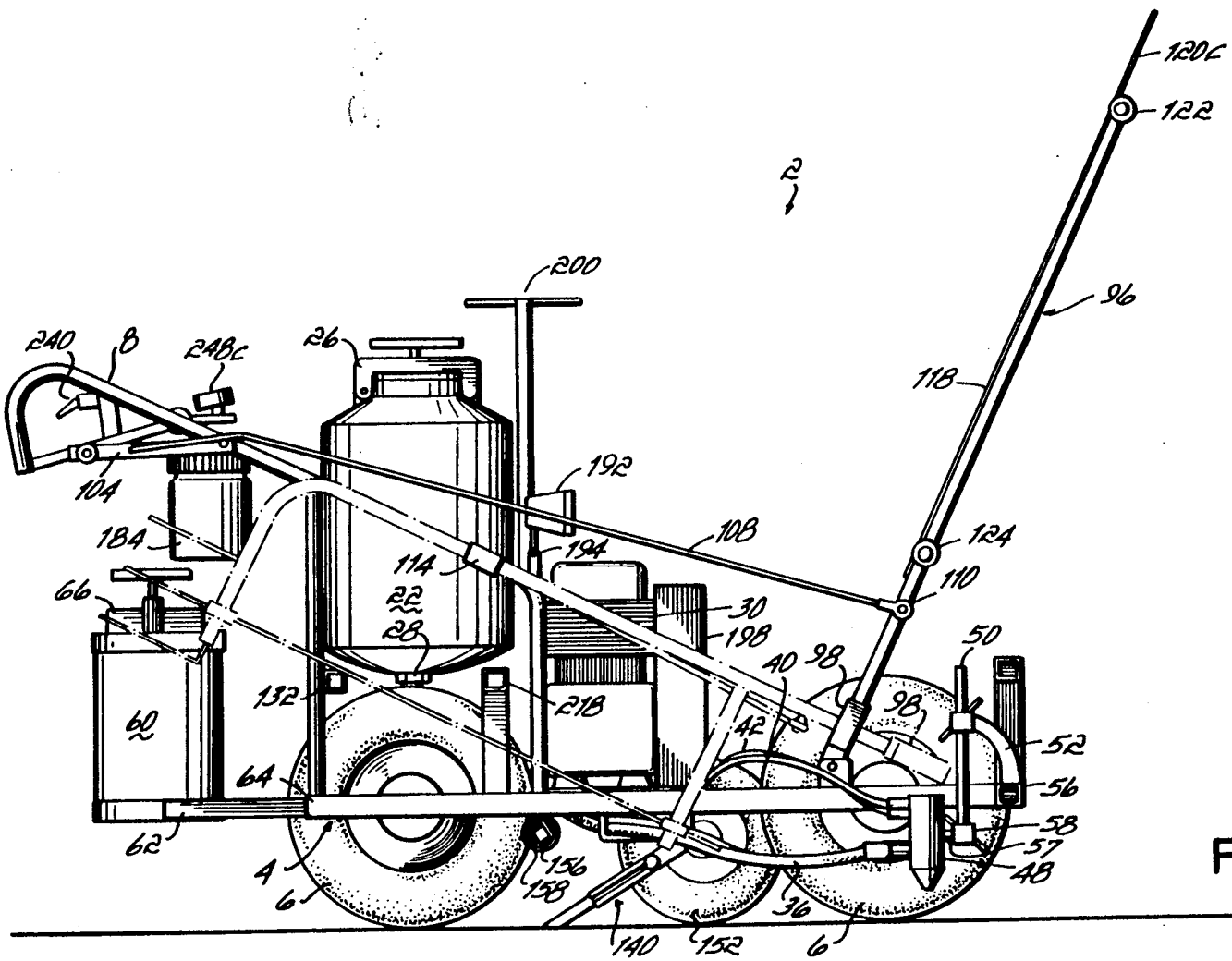
FIG. 3 is a side elevational view similar to FIG. 2 depicting the guide bar partially retracted.

Also mounted to the tubular frame 4 is guide bar 96 which has a tubular portion 98 which slidably engages the hinged guide bar mount 100, which in turn is secured to the tubular frame 4. The guide bar 96 is adjusted in height from a fully extended position forward of the tubular frame 4 as shown in FIGS. 1 & 2, to a partially retracted position by movement of the guide bar lever 104 mounted to handle assembly 8 as shown in FIG. 3. Guide bar lever 104 is connected to guide bar 96 via connector rod 108, which mates with guide bar 96 at the ball and socket joint 110. When not in use, the tubular portion 98 of guide bar 96 can be disengaged from guide bar mount 100, and the guide bar 96 can then be stored on the guide bar storage bracket 114 as shown in phantom lines in FIG. 3.

Another component of guide bar 96 and mounted forward thereof is guide fork 118 having three guide prongs 120*a, b,* and *c*. The guide fork 118 is mounted to the guide bar 96 by double split collars 122 and 124, which permit the guide fork 118 and prongs 120*a, b* and *c* to be adjusted laterally at the preference of the individual operator. The tips of prongs 120*a, b* and *c* indicate whether the line striper 2 is lined up correctly at a desired point. However, they do not provide optimal indication that the line striper 2 is moving in the correct direction. The guide fork 118 provides a much better indicator that the line striper 2 is proceeding along the desired line.

In certain applications, a guide member is preferably located near the operator. In that instance, a rear guide bar 128 (FIG. 1) having guide prongs, 130*a, b,* and *c,* is mounted to the tubular frame 4 by insertion into rear receiving tube 132. The rear receiving tube 132 can also accept a second paint gun. This gun is useful, for example, in striping parking stall lines which run perpendicular to a common end line, adjacent to a wall or other edge. With a single gun line striper 2, the operator would push the line striper 2 toward the end line while applying a paint stripe, then back the line striper 2 at an angle to the point where a parallel stripe should be applied. With added paint gun in the rear, the operator applies the first stall stripe, backs the line striper 2 to the adjacent line position near the end line, and applies a paint stripe using the rear paint gun.

To apply a guide line to the surface prior to applying a paint stripe, the line striper 2 employs guide line marking devices which can be positioned at several sites on the line striper 2.

The individual guide line marking devices 140, as shown in FIG. 1, are comprised of a chalk stick 142 and a receiver member 144. The chalk stick 142 may be formed of some other marking material, such as soap stone, or the like. The chalk stick 142 is retained in position inside receiver member 144 by locking bolt 146. As shown in FIG. 1, the guide line marking devices 140 are located near the ends of booms 150 which terminate at wheel 152. The booms 150 are adjustable in length, up to about 25 feet, so that the chalk stick 142 can apply a guide line at specific distances on one or both sides of the line striper 2 relative to the spray nozzle 48.

The boom 150 is attached to the tubular frame 4 via the rectangular receiver tube 156, which in turn rotates inside cylindrical housing 158 mounted to the tubular frame 4. The boom 150 mates with the rectangular receiver tube 156 at boom connector 160. The boom connector 160 is hinged to permit the boom 150 and wheel 152 to be rotated from a horizontal position upward and backward toward the operator to a laying back position of about 45° to the surface during maneuvering in constricted areas. The boom 150 is constructed of a light weight material such as aluminum to permit easier maneuvering of the line striper 2 and improved flexibility when extended out to compensate for uneven surfaces.

The guide line marking devices 140 remain in a raised position essentially parallel to the ground so that the chalk sticks 142 do not contact the surface until actuated by actuator levers 164 and 166, which respectively engage the guide line marking devices 140 on the left and right sides of the line striper 2.

Because the fixed plane wheels 6 on the line striper 2 do not swivel, the line striper 2 is not easily maneuverable during setup prior to line marking without raising the front wheel 6, nor can it be easily used to apply a paint stripe over a curved guide line or along a curved edge. In those situations where maneuverability is desired, an optional caster wheel 170 on a wheel mount 172 is inserted into a receiving tube 174 (FIG. 4) at the front of the line striper 2. The wheel mount 172 has a vertical length sufficient to raise the forward-most fixed plane wheel 6 out of contact with the surface to allow the line striper 2 to be maneuvered from side to side.

FIGS. 1 and 6 show the application of a paint stripe PS over a previously applied guide line GL. The operator in this instance is guiding off of guide prong 120*b* and guide line fork 118 in relation to guide line GL to apply the paint stripe.

FIG. 2 indicates the line of vision of the operator looking through the periscope 80 and viewing marker post 180, which serves as the fixed point toward which the line striper 2 is directed. Also shown is the solvent reservoir 184 which is connectable to the paint gun 48 to clean the paint gun 48 orifice and to the bottom of the reservoirs 20, 22, such as at bottom take off 28, to clean the paint lines. A spray gun 186 connectable to one or more paint reservoirs 20, 22 or 60 by a paint transfer line 188 is used to apply paint to support columns, posts and the like, and is also used for stenciling traffic flow arrows, directions, and the like to the surface.

The line striper 2 can be operated in low light conditions with the assistance of a spot light 192. The spot light 192 is capable of being rotated about support post 194 which allows directing the light beam on a specific operation of the line striper 2. The spot light 192 is powered by a 3 amp stator on the coil internal to engine 32. Good results have been obtained by use of a modified Tecumseh gasoline engine, four cycle, 5 horsepower, which is modified by the addition of the 3 amp stator inside the engine housing. The engine 32 and compressor 30 are isolated from the front of the line striper 2 by a fan belt guard member 198. The spot light 192 preferably utilizes a quartz-halogen lamp for increased illumination.

In the process of striping a surface, marking cones and paint stencils are often required. These accessories can be carried on the line striper 2 by securing them to the storage post 200. This post is a tubular member having two vertically extending prongs mounted at one end. The storage post 200 fits into a vertical mount (not shown) on the tubular frame 4. When the storage post 200 is affixed to the mount with the prongs up, stencils can be stored on the prongs. The storage post 200 can also be reversed (not shown) so that the prongs are adjacent the tubular frame 4. In this position, a single post without prongs extends upward, and marker cones can be stored on the post.

Figure 4:
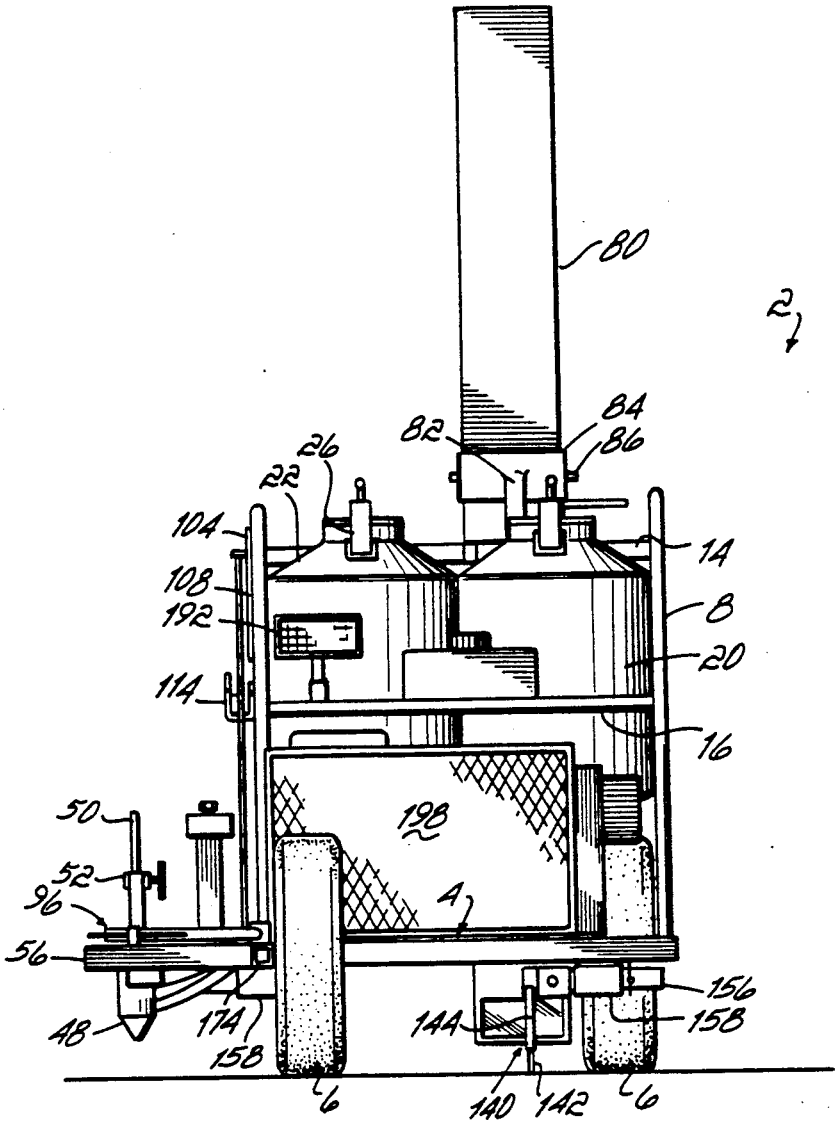
FIG. 4 is a front elevational view of the line striper device, further depicting the relationship between the viewing port of the periscope and the guide line marking device.
Figure 5:
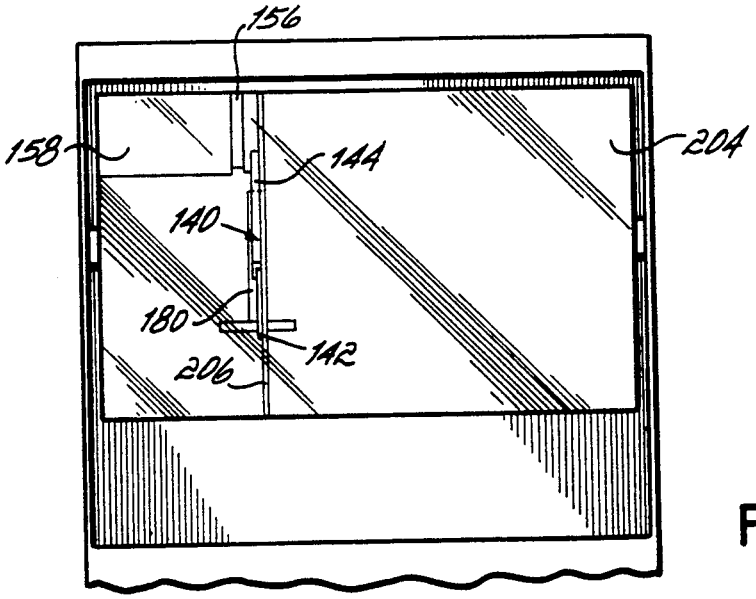
FIG. 5 is a depiction of the view seen by the operator when looking through the periscope toward a fixed point with the guide line marking device in contact with the surface to be marked.

FIGS. 4 and 5 further depict the alignment between periscope 80 and guide line marking device 140. The operator looking through the top of periscope 80 in viewing port 204 will see a sight hair 206 mounted in front of the mirror in the periscope 80. For applying a guide line, the sight hair 206 is mounted to the line striper 2 preset in alignment with the guide line marking device 140 mounted to the line striper 2 as shown in FIG. 4. After the starting point for a paint line is determined, the marker post 180 is placed near the end point of the line to be marked. When the line striper 2 is in the proper position for applying a guide line, the operator will have the sight hair 206, guide line marking device 140 and marker post 180 in the alignment shown in viewing port 204 in FIG. 5.

FIG. 6 further depicts boom 150, and specifically the adjustment collar 210 which allows a telescoping portion 212 of boom 150 to be moved in and out as necessary to achieve the proper distance of guide line GL from the paint stripe PS. Adjustment collar 210 rotates to release or tighten the telescoping portion 212 of boom 150 as needed.

Glass beads can be applied onto paint stripe PS by means of a glass bead holder 214 shown in phantom in FIG. 6. The glass bead holder 214 deposits beads onto the wet paint stripe PS by gravity feed. The glass bead holder 214 is secured to the tubular frame 4 at receiver tube 218, as shown in FIG. 1. The glass bead holder 214 is typically manufactured from aluminum and typically holds approximately fifty pounds of glass beads. The gate which allows the glass beads to flow from the glass bead holder 214 is pneumatically operated, the air pressure supplied by compressor 30 via an air line (not shown). Alternatively, the gate may be opened and closed by hand.

Figure 7:
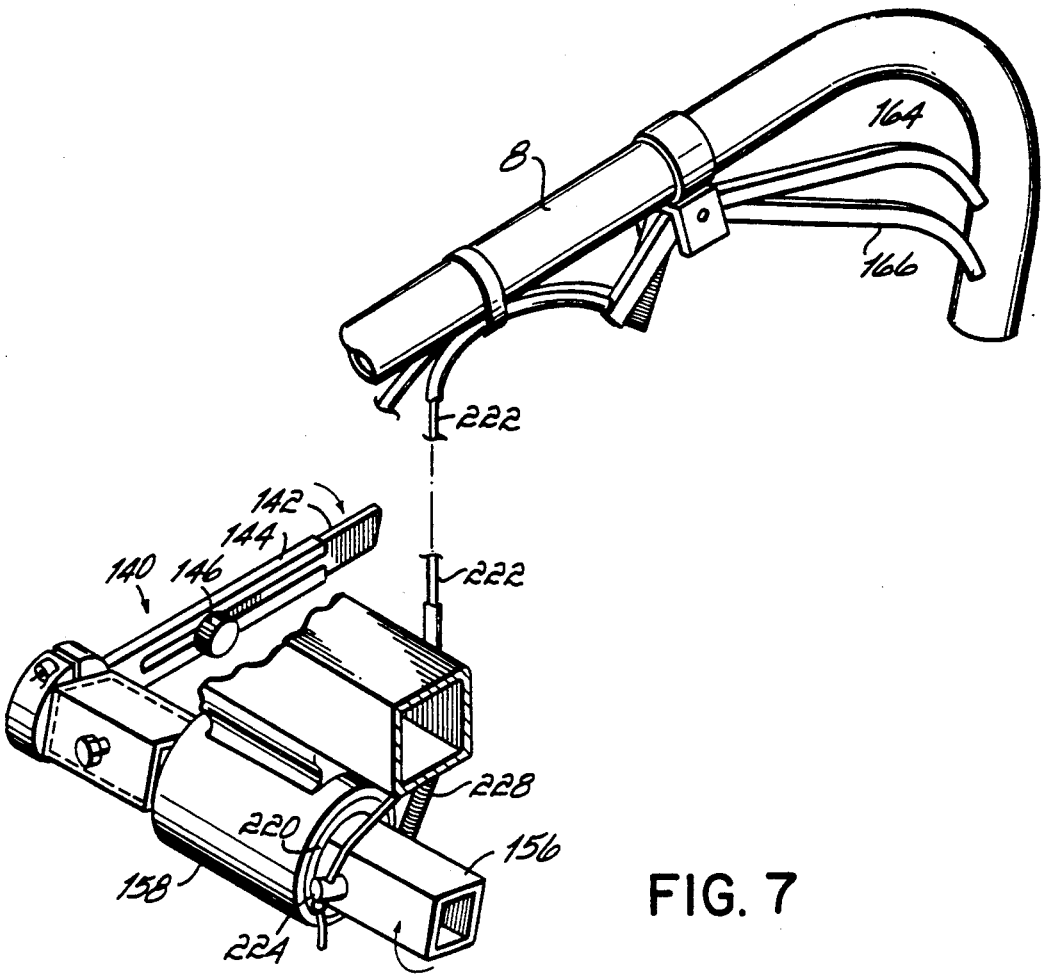
FIG. 7 is a fragmentary perspective view depicting the marking device lever on the handle of the line striper connected to the spring-loaded actuating mechanism for the marking device.

FIG. 7 is a more detailed view of the relation between the actuator levers 164 and 166 and the actuating mechanism for guide line marking device 140. The rectangular receiver tube 156 rotates inside the cylindrical housing 158 by means of bearing sleeve 220 which is secured to the rectangular receiver member on its inside diameter. As shown in FIG. 7, engaging actuator lever 166 causes cable 222 to be pulled toward handle 8. The cable 222, which is attached to rectangular receiver tube 156 by the cable lock pin 224, is rotated clockwise, thereby forcing the guide line marking device to also rotate clockwise and bring chalk stick 142 into contact with the surface. When the actuating lever 166 is released, the rectangular receiver tube returns to a rest position essentially parallel to the ground which removes the chalk stick 142 from contact with the surface, by means of relaxation of spring 228 which is hooked to tubular frame 4 and rectangular receiver tube 156 at holes drilled in these two members (not shown).

Figure 8:
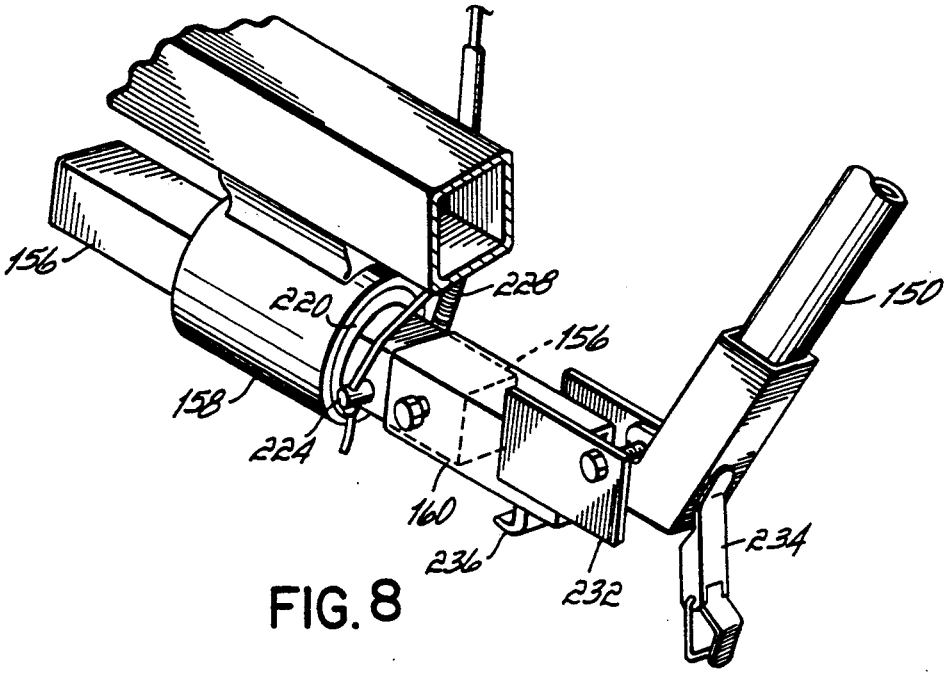
FIG. 8 is a fragmentary perspective view of the marking device actuating mechanism fitted with a boom, further showing the hingeable feature of the boom.

FIG. 8 is a detailed showing of the attachment of the boom 150 to rectangular receiver tube 156. Boom connector 160 is secured to the end of rectangular receiver member 156 by a locking bolt 230. The boom 150 is connected to the boom connector 160 by a hinge member 232. This hinge member 232 allows the boom 150 to be raised upward and backward to approximately a 45° position toward the operator as the line striper 2 is maneuvered in constricted areas. The boom 150 is locked in relation to boom connector 160 by the strap lock member 234, which engages locking hook 236. To rotate the boom 150 to its raised position, the strap lock member 234 is released from blocking hook 236 and the boom is manually raised.

As shown in FIGS. 1 and 2, paint is supplied to spray nozzle 48 by pressurizing one of the paint reservoirs 20 or 22, or optionally secondary paint reservoir 60. The flow of air is controlled by switching assembly 240 on air manifold 14. Air pressure is monitored by one or more of gauges 248*a, b,* or *c*. After the necessary air pressure is generated in the particular paint reservoir, the operating air line 40 is pressurized, opening a valve in the paint gun 48 and activating the paint atomizing air line 42. A three-way valve (not shown) is manually operated to initiate flow of pressurized paint from either paint line 36 or 38. It is appreciated that the use of a third reservoir would involve either attachment of a paint line from another reservoir after purging of the line, or by addition of a separate paint line and use of a different switching valve. The paint gun 48 is of the type available from Binks, Inc., such as Model No. 21, with a Model 709 air cap. The paint from the respective reservoirs is maintained in separate lines 36 and 38 until it reaches the single paint inlet tube 46, which is immediately downstream of the three-way valve. This arrangement permits changeover from one color to another with minimal clearing of paint lines, and consequently minimal use of cleaning solvents, with the attendant environmental hazards that relate to this cleaning. The combination of the optical sighting means, such as the periscope 80, guide bar 96, rear guide bar 128, and secondary guide bar 90, and booms 150 disposed on one or both sides of the line striper 2 provide a variety of means for aligning the line striper 2 to more efficiently apply a paint stripe in a variety of applications. As FIG. 1 indicates, as a paint stripe PS is applied, one or more guide lines can also be applied from either or both of the guide line marking devices 140 attached to the ends of booms 150 located on the left and right sides of the line striper 2. If a guide line needs to be applied in a much closer relation to the paint stripe, one or more guide line marking devices 140 of preset distance from the paint stripe line can be directly attached to the rectangular receiver members 156 beneath the tubular frame 4 on either side of the line striper 2 as shown in FIGS. 4, 7 and 8.

FIG. 9 depicts an alternative construction for the handle assembly 8, which provides additional operating flexibility for the line striper 2 where multiple operators use the machine. The end of the handle assembly 8 is adjustable in height by securing matable toothed, locking washers 260 and 262 on facing portions of the fixed and movable portions of the handle assembly 8, which are maintained in a fixed arrangement by the ribbed nut 264 threaded onto threaded rod 266.

The line striper 2 fitted with guide bar 96, which includes guide fork 118, provides substantial improvement in guiding the line striper in a number of applications. In the horizontally extended position, the guide fork 118 provides a line which the operator sights along the guide line, or forward of the applied paint stripe, to keep the paint stripe straight. It can be seen that the alignment is more likely to occur where the guiding member is a line overlying a surface line, instead of merely a point.

This feature is advantageous in striping an automobile stall or other straight line where the line striper 2 is moving toward the end line of the parking lot. A guide line typically is not applied beyond the end line. In many instances, the end line is at the edge of the surface, so that a guide line cannot be applied behind the end line. As the operator reaches about three to four feet from the end line, the prongs 120*a, b* and *c* extend beyond the end line. Without any other means of guiding the line striper 2, the operator can continue on essentially the same line without guidance, but inevitably some curve will appear in the final paint stripe. However, with the guide fork 118 in place, the operator can still sight onto the guide line until reaching the end line.

Tight radius curves can be applied to a surface by inserting the wheel mount 172 of caster wheel 170 in to receiving tube 174 and turning the line striper 2 while applying a paint stripe from the paint gun 48 in its position shown in FIG. 1. However, as the line striper 2 is turned, any bumps which the caster wheel 170 contacts causes a wavy appearance in the paint stripe. Where the caster wheel 170 is mounted forward, in receiving tube 174, a smoother radius curve is obtained by securing a paint gun into rear receiver tube 132. In this position, the rubber wheel 6 near the paint gun dampens out the bump transmitted from the caster wheel 170.

The line striper 2 has a number of receiving tubes constructed of telescoping steel tubing to accept various accessories. These accessories are secured in place after insertion typically by tightenable bolts threaded into the receiving tubes.

Thus it is apparent that there has been provided, in accordance with the invention, a line striper apparatus that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the sphere and broad scope of the appended claims.

What is claimed is:

1. A striping apparatus for applying a paint line to a surface, comprising:

a mobile platform;

paint dispensing apparatus mounted on said mobile platform and operable for applying a paint line to a surface; and optical sighting mans mounted on said platform, adapted to be viewed by an operator and operable to be sighted onto a point toward which said mobile platform is directed and which remains fixed during movement of said mobile platform, said optical sighting means facilitating the application of a paint line from said paint dispensing apparatus.

2. The striping apparatus of claim 1, wherein said optical sighting means is a periscope.

3. The striping apparatus of claim 2, wherein said periscope has a viewing port positioned below said mobile platform and adjacent to said surface.

4. The striping apparatus of claim 1, further comprising a guide bar connected to said mobile platform and extendable forward of said mobile platform.

5. The striping apparatus of claim 4, wherein said guide bar terminates with three equidistant horizontally extending guide prongs in parallel relationship.

6. The striping apparatus of claim 4 wherein said guide bar includes a linear member positioned parallel to a line of direction of said mobile platform.

7. The striping apparatus of claim 1, wherein said paint dispensing apparatus is comprised of at least one paint reservoir, an air compressor, and a paint gun.

8. The striping apparatus of claim 7, wherein said paint dispensing apparatus is comprised of two paint reservoirs.

9. A striping apparatus for applying a paint line to a surface and adapted to apply a discrete guide line to the surface, comprising;

a mobile platform;

paint dispensing apparatus mounted on said mobile platform and operable for applying a paint line to a surface upon which said mobile platform travels; and a guide line marking device connected to said mobile platform and adapted for marking a surface by selective engagement with the surface along a line spaced from said paint line.

10. The striping apparatus of claim 9, further comprising a guide bar connected to said mobile platform and extendable forward of said mobile platform.

11. The striping apparatus of claim 10, wherein said guide bar terminates with three equidistant horizontally extending guide prongs in parallel relationship.

12. The striping apparatus of claim 10 wherein said guide bar includes a linear member positioned parallel to a line of direction of said mobile platform.

13. The striping apparatus of claim 9 wherein said paint dispensing apparatus and said guide line marking device are operated simultaneously.

14. The striping apparatus of claim 9 further comprising optical sighting means mounted on said mobile platform adapted to be sighted onto a fixed point toward which said mobile platform is directed while a guide line is applied to said surface to be marked by said guide line marking device.

15. The striping apparatus of claim 9 wherein said guide line marking device is comprised of a chalk member and a holder therefor.

16. The striping apparatus of claim 15 wherein said guide line marking device is hingeably connected to said mobile platform.

17. The striping apparatus of claim 9 wherein said guide line marking device is connected t said mobile platform via a vertically extending boom member, said boom member terminating with a wheel.

18. The striping apparatus of claim 9 wherein said guide line marking device is selectively brought into engagement with said surface to be marked by an actuator remote from said guide line marking device.

19. A striping apparatus adapted for applying a paint line to a surface and adapted to simultaneously apply a discrete guide line to the surface, spaced from said paint line, comprising;

a platform mounted on fixed plane wheels;

a downwardly directed paint gun mounted to said platform and connected to a source of paint under pressure, said paint gun adapted to apply a paint stripe to said surface;

a guide bar connected to said platform and extendable forward of said platform to a position essentially parallel to said surface;

optical sighting means mounted on said platform adapted to be sighted onto a fixed point toward which said platform is directed; and a guide line marking device connected to said platform and adapted for selective engagement with said surface.

20. The striping apparatus of claim 19 further comprising a caster wheel mounted to said platform forward of said fixed plane wheels and adapted to raise said platform to thereby disengage at least one of said fixed plane wheels from said surface.

21. The striping apparatus of claim 19 further comprising a straight member connected to said optical sighting means, said straight member essentially parallel to said surface and essentially parallel to an axis of rotation of said fixed plane wheels.

22. A striping apparatus for applying a paint line to a surface, comprising:

a mobile platform;

a paint dispensing apparatus mounted on said mobile platform and operable for applying a paint line to a surface; and a guide bar connected to said mobile platform and extendable forward of said mobile platform, said guide bar comprised of at least two horizontally extending guide prongs in parallel relationship at the forward terminus of said guide bar.

23. The striping apparatus of claim 22 further comprising a linear member parallel to and behind said guide prongs.

24. The striping apparatus of claim 22, further comprising a second guide member comprised of at least two guide prongs, said guide member connected to said mobile platform and extendable rearward of said mobile platform.

* * * * *